US008720729B2

(12) United States Patent
Madai et al.

(10) Patent No.: US 8,720,729 B2
(45) Date of Patent: May 13, 2014

(54) FOIL FOR PROVIDING A PEEL-SEAL VALVE, PACKAGE COMPRISING THE FOIL, AND METHOD OF MANUFACTURING THE FOIL

(75) Inventors: Gyula Madai, Budapest (HU); Jan-Torsten Vollmer, Grabenstätt (DE); Melinda Budai, Vienna (AT); Michael Seeber, Klaus (AT); Bernhard Mumelter, Kufstein (AT)

(73) Assignee: Mondi AG (AT)

( * ) Notice: Subject to any disclaimer, the term of this patent is extended or adjusted under 35 U.S.C. 154(b) by 0 days.

(21) Appl. No.: 13/501,674

(22) PCT Filed: Oct. 13, 2009

(86) PCT No.: PCT/EP2009/063373

§ 371 (c)(1), (2), (4) Date: Apr. 12, 2012

(87) PCT Pub. No.: WO2011/044930

PCT Pub. Date: Apr. 21, 2011

(65) Prior Publication Data

US 2012/0205381 A1 Aug. 16, 2012

(51) Int. Cl.

| | |
|---|---|
| ***B65D 51/16*** | (2006.01) |
| *B65D 77/20* | (2006.01) |
| *B65D 81/34* | (2006.01) |

(52) U.S. Cl.

CPC ..... *B65D 51/1633* (2013.01); *B65D 77/206* (2013.01); *B65D 81/3446* (2013.01); *B65D 51/1638* (2013.01)

USPC ..... 220/367.1; 220/203.1; 220/202; 206/484.2; 206/484.1; 206/484; 383/100; 383/101; 383/103

(58) Field of Classification Search

USPC ..... 220/367.1, 203.1; 156/87; 429/56; 383/103

See application file for complete search history.

(56) References Cited

U.S. PATENT DOCUMENTS

| | | | | |
|---|---|---|---|---|
| 5,039,001 | A * | 8/1991 | Kinigakis et al. | 229/120 |
| 6,663,284 | B2 * | 12/2003 | Buckingham et al. | 383/103 |
| 8,245,869 | B2 * | 8/2012 | Yasumuro et al. | 220/359.4 |
| 2001/0012530 | A1 | 8/2001 | Hiyoshi | |
| 2003/0035597 | A1 | 2/2003 | Buckingham et al. | |
| 2008/0310770 | A1 | 12/2008 | Turvey et al. | |
| 2009/0035424 | A1 * | 2/2009 | Mita et al. | 426/113 |

FOREIGN PATENT DOCUMENTS

WO WO 9301104 A1 * 1/1993

OTHER PUBLICATIONS

English language translation of the International Search Report and Written Opinion.

* cited by examiner

*Primary Examiner* — Andrew Perreault
*Assistant Examiner* — James M Van Buskirk
(74) *Attorney, Agent, or Firm* — Ostrolenk Faber LLP

(57) ABSTRACT

A foil made of two plastic films and an adhesive layer laminating the two films together, wherein the first plastic film has a first side and a second side and comprises punctures therebetween. The foil is of a dual peel-seal type such that the first plastic film realizes a first peel-able seal within the foil at its first side in the form of an adhesion peel seal in an open state and/or in the form of a cohesion peel seal in a sealed state, and wherein the adhesive layer leaves open the punctures such that gas can penetrate through the punctures in-between the two films towards the first peel-able seal.

10 Claims, 10 Drawing Sheets

FOIL FOR PROVIDING A PEEL-SEAL VALVE, PACKAGE COMPRISING THE FOIL, AND METHOD OF MANUFACTURING THE FOIL

CROSS REFERENCE TO RELATED APPLICATION

The present application is a 35 U.S.C. §371 national phase conversion of PCT/EP2009/063373 filed Oct. 13, 2009, incorporated herein in its entirety.

FIELD OF THE INVENTION

The invention relates to a foil of the peel-seal type that realizes a valve of a food package.

The invention also relates to a package for food comprising a tray and a lid made from a foil according to the first paragraph.

The invention also relates to a flexible package made from a foil according to the first paragraph.

The invention further relates to a method of manufacturing a foil of the peel-seal type that realizes a valve of a food package.

BACKGROUND OF THE INVENTION

Today food products are often pre-prepared and sold as so-termed convenient meals. For consumer convenience such meals are packed in packages allowing for the heating or cooking of the meal contained therein without removal of the packaging. When heated up, e.g. in a microwave oven, typically moisture contained in the food converts into steam. In order to cope with the rise of the internal gas-pressure such a package comprises a valve, which allows the steam to escape from the package without exploding. At the same time the valve controls the internal steam or gas-pressure as an important parameter for cooking the meal.

Some solutions of these packages rely on a combination of a tray or bowl or the like tightly sealed with a lid. The lid is made of foil that realizes a valve. The valve is created by means of perforations of the foil, wherein the perforations are covered by a layer made of hot melt glue, adhesive, lacquer or the like. Once the hot melt glue is heated—e.g. by the steam created inside the tray—it starts to become permeable for the steam, such that the steam can escape through the perforations with a certain flow rate. This prevents the package from exploding and also allows the pressure to be kept relatively stable within the package while cooking the meal.

Basically this known innovative concept fulfills the requirements for several applications. However, it also shows some drawbacks. For example, as soon as the temperature range used is extended towards extremely low temperatures, the solution may suffer in terms of reliability. At such low temperatures—e.g. in case of shock freezing at −90° C.—the layer covering the perforations tends to become porous or fissured. Hence, it does not any longer tightly seal the perforations.

But also regulatory frameworks may hamper the usability of the package. Typically the food or meal contained in the package is not allowed to come into contact with the material of the layer, which during normal use will not be the case at all. However, improper handling of the package like placing it into a microwave oven up-side-down with the lid facing downward would certainly lead into a situation in which the food via its liquid components would probably come into contact with the melting hot melt glue or layer. Such accidental food contact is heavily undesired.

But also during the manufacturing of the lid and its consecutive handling or transportation several drawbacks are introduced by the layer based solution. Typically the foil would have a thickness of 65 μm while the layer would be in the range of 150 μm. This in fact creates a sort of a bump on the plane foil. The mass production of the lid however requires that several lids must be stored on a roll or in a magazine such that further processing in a highly automated food and package-processing equipment is possible. For both storage systems—roll or magazine—the existence of the bump creates difficulties and may led to malfunction during automated handling of the storage system.

A further back draw of the solution with melting layer is its sensitivity to heat, hence its use is limited to chilled and ambient temperatures.

In other group of solutions label carrying the valve function over a scribed or punctured web is applied. Application of the label can be a process bottle neck either at the converter or on the end user's packaging machine. Offline manufacturing of label alone also imposes high costs on the solution.

Further group of valve solutions use peel able lacquers applied in the sealing area in between the lid and the tray or between two layers of the lidding film in the tray sealing area whilst the food contact layer of the lidding film is cut also in the sealing area and represents a potential risk of leakage of the pack.

Therefore, it is an object of the present invention to overcome the problems identified above and to provide an improved foil of the peel-seal type that realizes a valve of a food package, a package for food that comprises a tray and such a foil or a flexible package for food that is formed by such a folded and sealed together foil, as well as a method of manufacturing such a foil.

SUMMARY OF THE INVENTION

In order to achieve this object there is provided a foil of the peel-seal type that realizes a valve of a food package, the foil comprises a first plastic film, and a second plastic film, and an adhesive layer interposed between the first plastic film and the second plastic film that laminates together the two films, wherein the first plastic film has a first side and a second side and comprises punctures and is of a dual peel seal type such that the first plastic film realizes a first peel-able seal within the foil by the aid of its first side in the form of an adhesion peel seal in its open state and/or in the form of a cohesion peel seal in its sealed state, wherein in its sealed state the first peel-able seal is sensitive to gas-pressure that is built up by gas that entered into the foil through the punctures between the two films, such that the first peel-able seal is peeled-off if said gas-pressure exceeds a threshold and the gas can depart from the foil by passing along in-between the two films, and the first plastic film allows to cerate a second peel-able seal by the aid of its second side when sealed together with a structure, the second peel-able seal is non-sensitive to said gas-pressure, and wherein the adhesive layer leaves open the punctures such that gas can penetrate trough the punctures in-between the two films towards the first peel-able seal.

The object is also achieved by a package for food that comprises a tray and a foil according to the invention, wherein the foil forms a lid of the package and the edge of the tray is sealed to an outer region of the second side of the first plastic film of the foil, such that the second peel-able seal is created Further to this the object is achieved by a flexible package for food that is formed by a folded and sealed together foil according to the invention, such that the second peel-able seal is created.

Also a method of manufacturing a foil of the peel-seal type that realizes a valve of a food package achieves said object, wherein said method of manufacturing comprises the steps of using a first plastic film, and using a second plastic film, wherein the first plastic film has a first side and a second side and is of a dual peel seal type, such that the first plastic film realizes a first peel-able seal within the foil by the aid of its first side in the form of an adhesion peel seal in its open state and/or in the form of a cohesion peel seal in its sealed state, wherein in its sealed sate the first peel-able seal is sensitive to gas-pressure that is built up by gas that entered into the foil, such that the first peel-able seal is peeled-off if said gas-pressure exceeds a threshold and the gas can depart from the foil by passing along in-between the two films, and such that the first plastic film allows to create a second peel-able seal by the aid of its second side when sealed together with a structure, the second peel-able seal is non-sensitive to said gas-pressure, and creating punctures in the first plastic film, and applying an adhesive layer on the second plastic film while leaving open the punctures in the first plastic film, and adhering the second plastic film on the first plastic film by the aid of the adhesive layer, such that gas can penetrate through the punctures in-between the two films towards the first peel-able seal.

The term "peel-seal type" shall mean a foil made of a material that can be used to form a peel-able seal when sealed together with another material or with itself.

For the avoidance of doubt the term "peel-able seal" shall mean that one material sealed together with another material or even with itself—hence forming a seal—allows the seal to be opened when exposed to a force.

With regard to the force needed to peel-off the respective peel-able seal it is clarified that the term "non-sensitive to said gas-pressure"—when compared with the term "sensitive to gas-pressure" shall mean that the second peel-able seal will not peel-off under normal conditions, in which the first peel-able seal will peel-off and consequently the gas-pressure will always be below a peel-off force necessary to peel-off the second peel-able seal.

Therefore, the expression "threshold" shall mean the value of the gas-pressure necessary to open/peel-off the first peel-able seal.

The term "dual peel seal type" shall mean a peel-ability on both sides of a plastic film, wherein the peel-ability properties shall be different on both sides with respect to the force necessary to open the seal as just explained in above paragraph.

The expression "punctures" shall not be understood in a way of limiting the form of such punctures to round or circular or tubular structures only. In fact also structures having an elongated form in the plane of the foil—like slits or the like—shall be comprised within the meaning of this expression.

Hence, the foil of the dual peel seal type allows the use of one and the same plastic film for the creation of two different functions, which on the one hand is the creation of a seal of a package that can be broken by a user when opening the package—hence requiring a relatively high force to be applied—and on the other hand is the creation of another seal that can be broken by the gas pressure that is built up during heating up of moisture contained in food within the package—hence requiring a relatively low force to be applied in comparison to the other seal.

The invention provides the advantage that all functions of the valve are located inside the foil and the outside of the foil looks and feels like it would be a foil without a valve, so to say a conventional single or multi-layer foil.

Consequently, the foil according to the invention does not show any deviations from a plane foil structure. It can be easily stored on a roll of material or in a magazine and used out of such storage systems. The further usage of such a foil can be performed with already existing tools and machinery without any modifications or adaptations of such tools or machinery. Also the handling of the package by a user is self-evident and the function of the valve does not require any caution by the user. Hence malfunction of the valve or accidental non-desired or even forbidden food contact with a package component is now avoided without further user attention. Also very low temperatures do not affect the reliability of the valve function.

Advantageously the foil creates an over-pressure valve functionality, wherein the punctures form an entry portion of the valve and the respective seal forms an outlet portion of the valve. The entry portion is located in the planar extension of the foil and the outlet portion is located in the outer edge of the foil. As such the foil not only acts as an over pressure valve but also as a means for redirecting the gas flow direction from a direction perpendicular to the planar extension at the entry portion of the foil—which in fact is the direction of the punctures—into a direction that is defined by the planar extension of the foil, because once entered into the foil the gas propagates within the foil along the orientation of the two plastic films towards the outlet portion.

The material of the two films can be selected according to the desired application of the film.

For example, in one particular application as a lid for a tray, wherein the tray is manufactured from polypropylene (PP), the first plastic film is made from cast polypropylene (CPP). Hence the second peel-able seal is made by heat-sealing of the foil with the tray wherein the PP is sealed together with the CPP. In this application the second plastic film is made of polyethylene (PET) and the adhesive layer is made of solvent based adhesive applied on the second plastic film on that side of the second plastic film that faces the first plastic film. The two films are laminate together by the aid of the adhesive.

If the foil is used in an application in which the foil itself forms the package of the food—e.g. the foil is used in a form fill and seal (FFS) machine—the first plastic film needs to have a second side that is sealable against itself or otherwise, if one part of the foil is folded over the other part, it should be sealable against the second plastic film. In all cases it is of advantage that the first plastic film (CPP or PE) is made of a triplex co-extruded foil.

In particular, if a usability of the foil in deep-freezing or shock-freezing applications needs to be considered the first plastic film can be made of a co-extruded polyethylene (PE) foil instead of CPP. In this case, e.g. if a lid and tray combination is desired, the lid made of the co-extruded PE is sealed against the tray made of PE and in case of a form fill and seal (FFS) application the co-extruded PE is sealed against itself. In both forms of realization (package having lid and tray sealed together/flexible package sealed with itself) also the second plastic film—as mentioned to be of PET—can be realized by a normal CPP, oriented polypropylene (OPP) or oriented polyamide (OPA).

The foil or the package according to the invention can also be used for heat sterilization of food or other content of a package made from or by the aid of said foil. In case of heat sterilization the adhesive layer needs to be non-sensitive for the heat created during the sterilization process in order to avoid heat-caused destruction of the foil. Taking the low melting point of PE into account, the PE needs to be substituted by e.g. PP, which is characterized by a higher melting point than PE and therefore can withstand the temperatures used during the sterilization process. During the process of sterilization the package made of said foil is placed in an autoclave that balances the gas-pressure within the autoclave to be at the same level as the gas-pressure within said package in order to avoid an opening of the valve in the foil due to overpressure within the package.

In general, also the second plastic film may be realized as a multi-layer film.

In summary it is emphasized that the selection of the appropriate material for the components of the foil allows to cerate a package that can be used in all temperature ranges to be considered between shock- or deep-freezing and sterilization.

In addition to the above-discussed topics, the valve according to the present invention provides a further feature, which is re-close-ability. Once the first peel-able seal is broken due to heating up of the content of the package, gas that comprises moisture penetrates the inside of the foil. As soon as the heating is stopped, the package cools down and the moisture condenses within the channel of the foil. The cooling down also creates a vacuum effect within the package and the channel of the foil, which causes neighboring portions of the channel of the foil to approach each other and to stick to each other because of the moisture inside the channel. This is termed glass plate effect. Due to the reduced gas-pressure within the package in comparison to normal atmospheric pressure outside of the package and the glass plate effect the valve remains in its sealed state, or in other words—the once peeled-off seal is re-closed. This feature may be used for products, which are filled in the package and have to undergo a sequence of multiple temperature cycles, e.g.: the package is closed, the product is pasteurized in a microwave oven—here the peel-able seal is broken—the product is cooled down—here the glass plate effect re-closes the valve—and finally the product is heated up and boiled in a microwave oven—here the seal is opened again due to the rise of the gas-pressure within the package.

The dependent claims and the subsequent description disclose particularly advantageous embodiments and features of the invention, whereby, in particular the method according to the invention may be further developed according to the dependent foil claims.

The invention can be applied to realize the valve function within a foil—namely the first peel-able seal—according to two different underlying physical principles.

The first physical principle used is the adhesion. Accordingly in one embodiment of the invention the adhesive layer leaves open a channel that extends between the punctures and the first peel-able seal, wherein the first peel-able seal is located at an outer edge region of the foil and is realized in its sealed state when the first side of the first plastic film is sealed together with the second plastic film in order to create said adhesion peel seal in its sealed state. The force necessary to re-open the so created seal is determined by the adhesion between the material of the first plastic film and the second plastic film, which are sealed together in said outer edge region of the foil where no adhesive is applied.

The second physical principle used is the cohesion. According to another embodiment of the invention between the two films the adhesive layer tightly seals the punctures from an outer edge of the foil and the first peel-able seal in the form of the cohesion peel seal is realized by the aid of the first plastic film that is designed to create in its structure a cohesive crack adjacent to the adhesive layer. In this embodiment the force necessary to re-open the so created seal is determined by the cohesion of the material used as the first plastic film, which is laminated together with the second plastic film. For the avoidance of doubt it is clarified that the term "tightly seals the punctures" does not mean that the adhesive is applied at the location of the punctures. Rather more this term means that the punctures are isolated from the outer edge of the foil when viewing between the two films from a position of a puncture in direction towards the outer edge of the foil. When gas-pressure rises between the two plastic films and reaches the threshold, the crack in the plane of the first plastic film is created and a part of the first plastic film remains glued to the adhesive layer.

For both embodiments the advantage is identical. What is achieved is a tunnel for the gas within the plane structure of the foil that is created solely by the force of the gas-pressure that pushes the two plastic films away from each other and opens/peels-off the first peel-able seal.

In the context of above mentioned seal types (adhesion peel seal/cohesion seal type) it is to mention that a plastic film for realizing a particular seal type and the method of manufacturing such a film is basically known. These types of seal are typically achieved by disturbing or destroying the homogeneity of the foil by means of adding some additive polymers. However, in contrast to the known art, here in the context of this invention the first plastic film is tuned on both of its side to create the desired peel seal behaviors, wherein different tuning measures are applied for each side. For example, provided that a CPP based first plastic film is to be considered, this film may show a three-layer structure that comprises a middle layer accompanied by two outer layers. The middle layer, namely the so termed core layer, may be made from a homo-polymer or a block polymer. A further layer forming the first side of the first plastic film may be modified by means of the appropriate in-homogeneity, such that the first side can be used to cerate the adhesion peel seal or the cohesion peel seal. A further layer forming the second side of the first plastic film may also be modified by means of the appropriate in-homogeneity, such that the second side can be used to cerate the adhesion peel seal. This design of the first plastic film integrates two different peel seal functionalities within one film.

According to a first aspect of the second embodiment the sealing of the punctures is realized by a solidly extension of the adhesive layer around an area of the punctures. In this embodiment only the area of the punctures is left free from adhesive, while apart from this area the two films are completely laminated onto each other. This solution is of particular interest if it is decided to have the area of the punctures grouped, e.g. in a circle, and located in close proximity to the outer edge of the foil. This allows limiting the distance necessary to create the tunnel in form of the crack in the first plastic film and therefore also limits the force necessary to create the crack to a desired value, which otherwise would hardly be possible to achieve.

According to a second aspect of the second embodiment the sealing of the punctures is realized in form of a number of stripe-like extensions of the adhesive layer located within a channel into which the punctures are entering, the channel extends between the two films and ends at the outer edge region of the foil. This solution also allows controlling the gas flow within the two plastic films in any desired direction. Also the force to be applied to create a crack is better controlled and can be better tuned when compared with the first aspect of the second embodiment.

With regard to the second embodiment it is to mention that the stripes may be located along the channel at any desired position while leaving out the position of the punctures. The direction of the stripes may also be alternated from stripe to stripe or group of stripes. Stripes may also overlap in order to cerate a web-like structure within the plane or more precisely along the channel and openings of the punctures may be located in-between the stripes. However, in a preferred embodiment the number of stripes is located adjacent to the outer edge region of the foil in an area of the channel that is free of punctures. This embodiment provides the advantage that the force necessary to cerate the cracks at the position of the stripes is lower and can be better controlled and the risk of applying adhesive at a position of a puncture is reduced or completely avoided. Hence, the punctures can be created at any arbitrary position along the channel provided that the outer region of the foil where the stripes are located is omitted. Hence, the stripes and punctures do not any more need to be created in register with each other.

Basically the channel may end only at one position at the outer edge of the foil. This is true not only for the second embodiment but also for the first embodiment. However, in the context of the second embodiment it has proved to be of particular advantage if the channel ends at the outer edge of the foil at two different positions. In particular, the channel may have a form of a straight line with parallel channel boundaries and openings of the punctures are distributed within said channel. When orienting the channel in direction of the manufacturing process the application of the adhesive and the creation of the punctures are widely decoupled, hence creation of the adhesive layer and the punctures is simplified.

Also the first embodiment is significantly improved in terms of manufacturing art if the adhesive layer leaves open a channel that has a form of a straight line with parallel channel boundaries and openings of the punctures that open into the channel, wherein said openings are aligned in a row in parallel to the channel boundaries and the channel ends at the first peel-able seal at two different positions. In the present case the generation of the puncture and the application of the adhesive layer on both sides of the channel can be performed out of register. This significantly reduces the accuracy requirements in the manufacturing process of the foil.

Other objects and features of the present invention will become apparent from the following detailed descriptions considered in conjunction with the accompanying drawings. It is to be understood, however, that the drawings are designed and the description shall be used solely for the purposes of illustration of the invention and not as a definition of the limits of the invention.

DETAILED DESCRIPTION OF EMBODIMENTS

Figure 1:
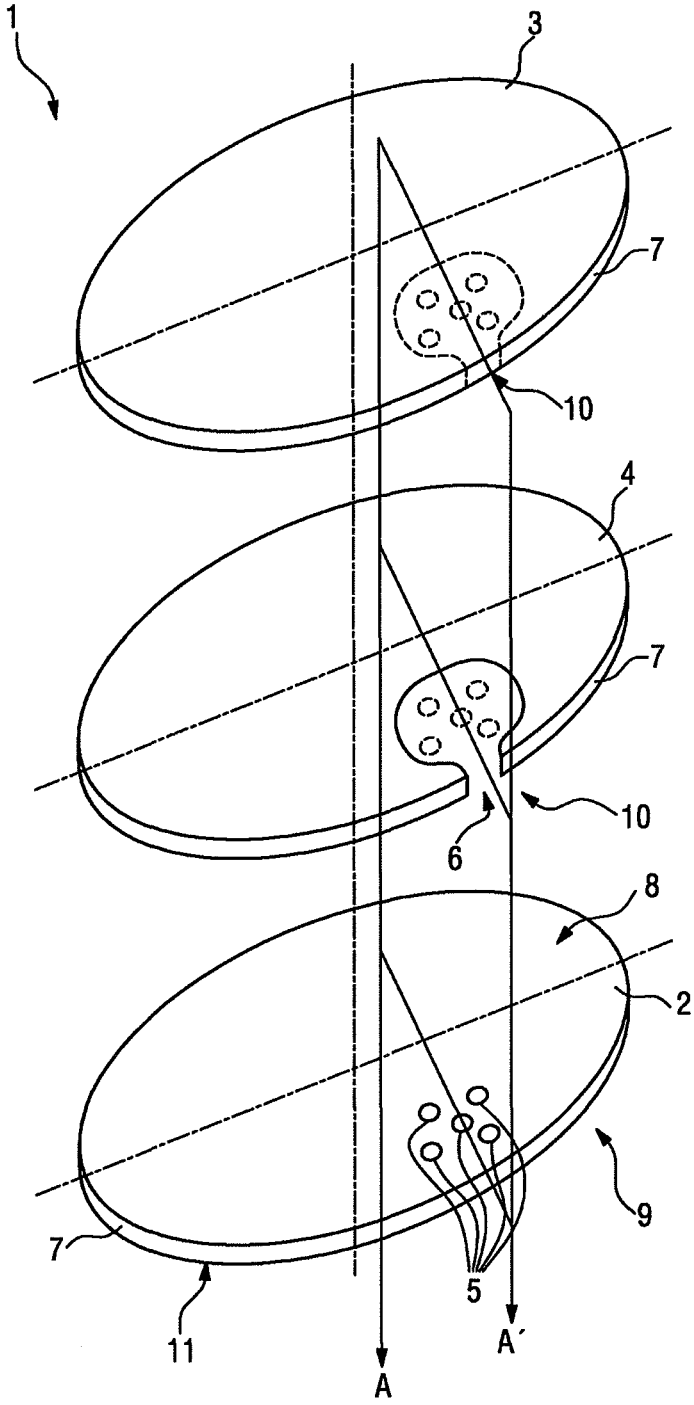
FIG. 1 schematically shows a first embodiment of a foil according to the invention.

FIG. 1 shows three layers of a foil 1 according to a first embodiment of the invention, wherein each layer is typically in contact with its neighboring layer(s) but for the sake of clarity in FIG. 1 shown with distance to each other. The three layers are a first plastic film 2, a second plastic film 3 and an adhesive layer 4 interposed between the first plastic film 2 and the second plastic film 3. The adhesive layer 4 laminates the two films 2 and 3 together.

The first plastic film 2 comprises a number of punctures 5, wherein in the present embodiment only five of these punctures 5 are shown because of clarity reasons. In reality the number of punctures 5 might be selected to be much higher and the diameter of the punctures 5 might be much smaller. In the two layers visualized above the first plastic film 2 broken lines indicate the position of the punctures 5 schematically. The adhesive layer 4 leaves open the punctures 5 such that gas can penetrate through the punctures 5 in-between the two films 2 and 3. The area surrounding the punctures that is free from adhesive is also schematically indicated in the top layer of the foil 1, which is the second plastic film 3. The area that is free from adhesive extends away from the punctures 5 in form of a channel 6 and ends at the outer edge 7 of the foil 1. Its form could most probably best be described by the term "bay", wherein the bay is open to the outside of the foil 1 either through the punctures 5 or through the channel 6 as long as the foil 1 is not used in combination with another structure.

The first plastic film 2 has a first side 8 (visible because facing upward in FIG. 1) and a second side 9 (not visible because facing downward in FIG. 1) and is made of material that allows the first plastic film 2 to realize a first peel-able seal 10 and a second peel-able seal 11, wherein each of its sides 8 and 9 is associated to one of the two seals 10 and 11. Therefore the first plastic film 2 is termed to be of a dual peel seal type.

In details, the first plastic film 2 allows to realize the first peel-able seal 10 within the foil 2 by the aid of its first side 8. As long as the foil 2 is just manufactured and not used in combination with another structure the first peel-able seal 10—in the present situation am adhesion peel seal—is in its open state. In this context the term "allows to realize" shall mean that the first side 8 of the first plastic film 2 needs to be sealed together with the bottom side of the second plastic film 3 in an area close to the outer edge 7 such that the channel 6 is closed, which cerates an adhesion peel seal in its closed/sealed state. This is visualized in FIG. 2 in which the foil 1 is used as a lid 12 for a tray 13. The so created package 14 is used to pack some food (not shown) that can be heated up in a microwave oven (not shown) while being in the closed tray. Both FIGS. 2 and 3 show a part of a sectional drawing of the package 14 along the cut surface A-A' as indicated in FIG. 1.

Figure 2:
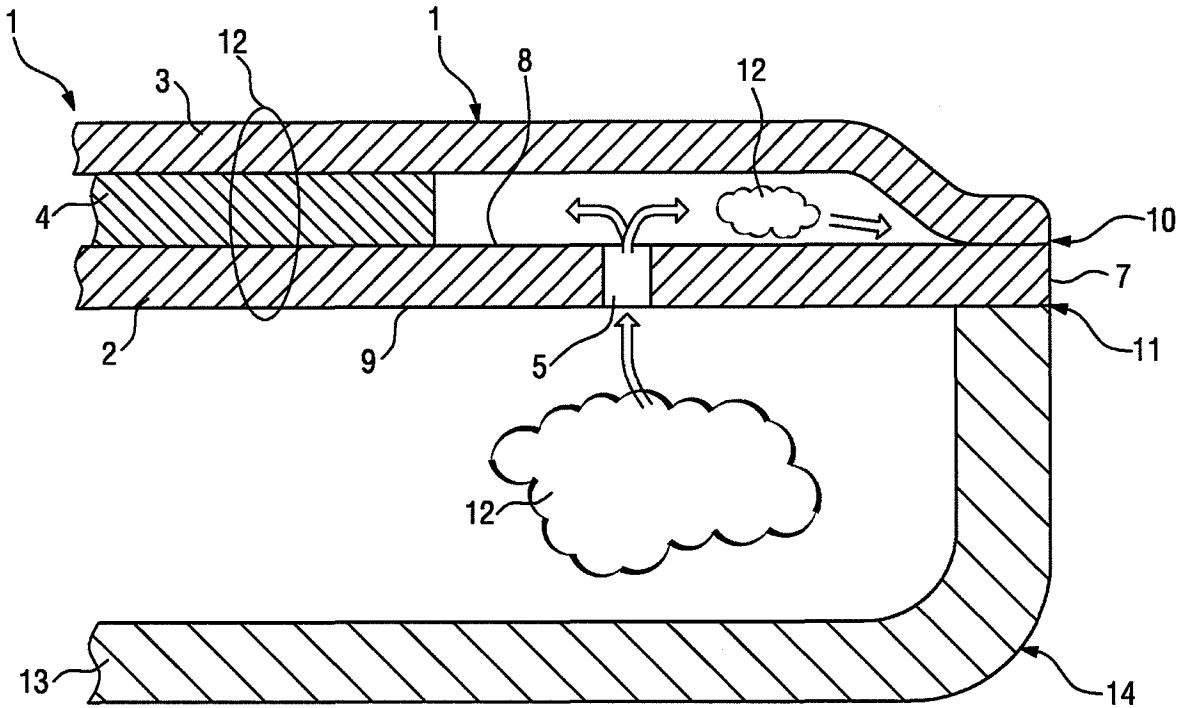
FIG. 2 schematically shows a package having the foil according to FIG. 1 as a lid for a tray with a closed first peel-able seal.
Figure 3:
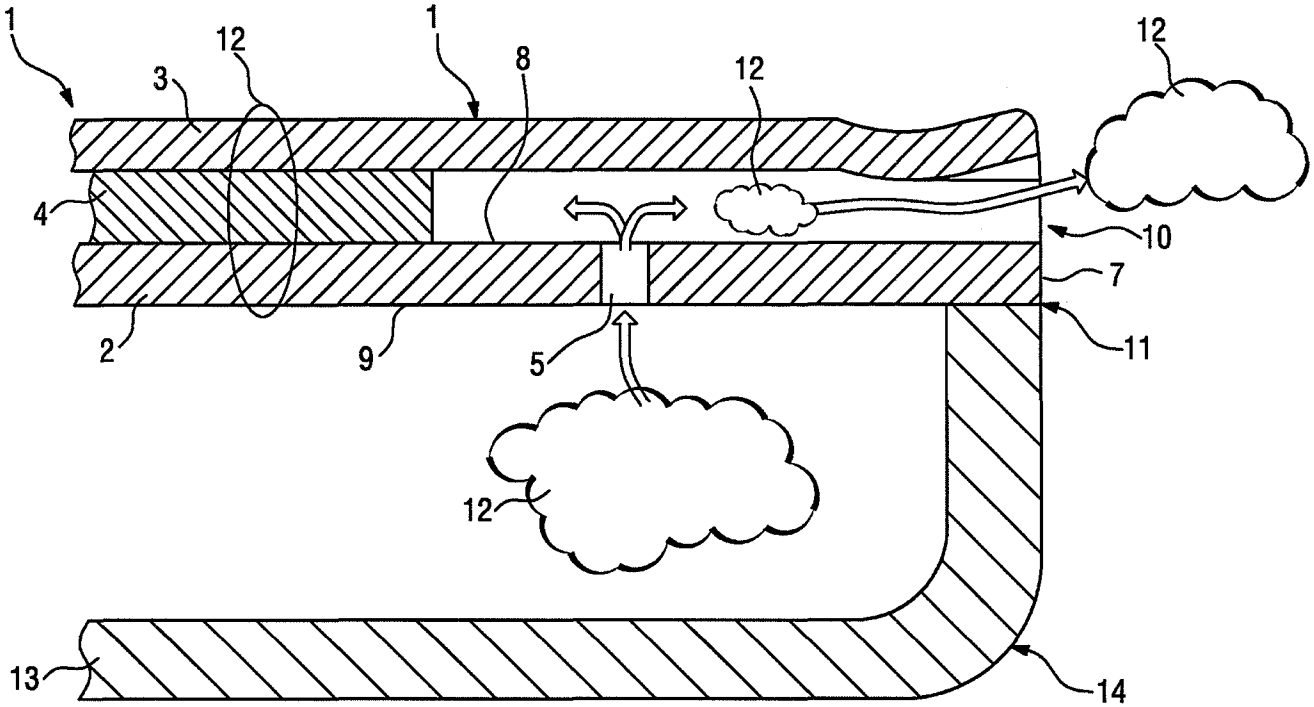
FIG. 3 schematically shows the package according to FIG. 2 with an opened first peel-able seal.

Gas—as indicated by a cloud of steam 12 in FIGS. 2 and 3—can enter into the foil 2 through the punctures 5 between the two films 2 and 3. The closed channel 6 allows gas to reach the first peel-able seal 10 that is sensitive to gas-pressure and to build up gas-pressure within the foil 1. The gas can depart from the foil 2 passing along in-between the two films 2 and 3 as soon as the first peel-able seal 10 is peeled-off or ruptured by said gas-pressure, which is shown in details in FIG. 3.

The first plastic film 2 also allows creating a second peel-able seal 11 by the aid of its second side 9 when sealed together with a structure, which in the present embodiment is the tray 13. The second peel-able seal 11 is non-sensitive to the gas-pressure that builds up in the package 14. It can be peeled-off or in other words opened by a user. Therefore the lid 12 could be equipped with a flap (not shown) or the like that allows a user to grasp the lid 12 and pull it away from the tray 13.

The foil 2 is manufactured according to an inventive method, which is described in the following.

In a first step on the second plastic film 3 there is created an image by means of printing technology. The image may be reversely printed on the surface that will face away from the first plastic film 2 or on the surface that will face the first plastic film 2.

In a next step the first plastic film 2 is punctured. This may be achieved by means of a laser, by means of pressing or by means of a rotary die cut device or the like. The puncturing is precisely aligned (in register) with some printing control marks on the film 2 or 3.

In a further step the lamination of the two plastic films 2 and 3 is performed. First of all the adhesive is applied on that side of the second plastic film 3 that shall face the first side 8 of the first plastic film 2, wherein the region of the punctures 5 and the channel 6 is kept free from adhesive. This is achieved by aligning the interaction of e.g. a adhesive-application-cylinder with the printed eye mark on the second plastic film 3. This step creates the adhesive layer 4 on the second plastic film 3 in register with the printed image. Thereafter the first plastic film is supplied in from of a web unwound from a roll and pressed onto the adhesive layer 4 with its first side 8 in a so-called lamination process.

Out of the sandwiched layers the desired form of the foil 2 is thereafter cut out or punched out, such that at its outer edge 7 the adhesion peel seal is in its open state.

Some of the steps explained above may be performed in different sequence or may be performed at the same time.

Figure 4:
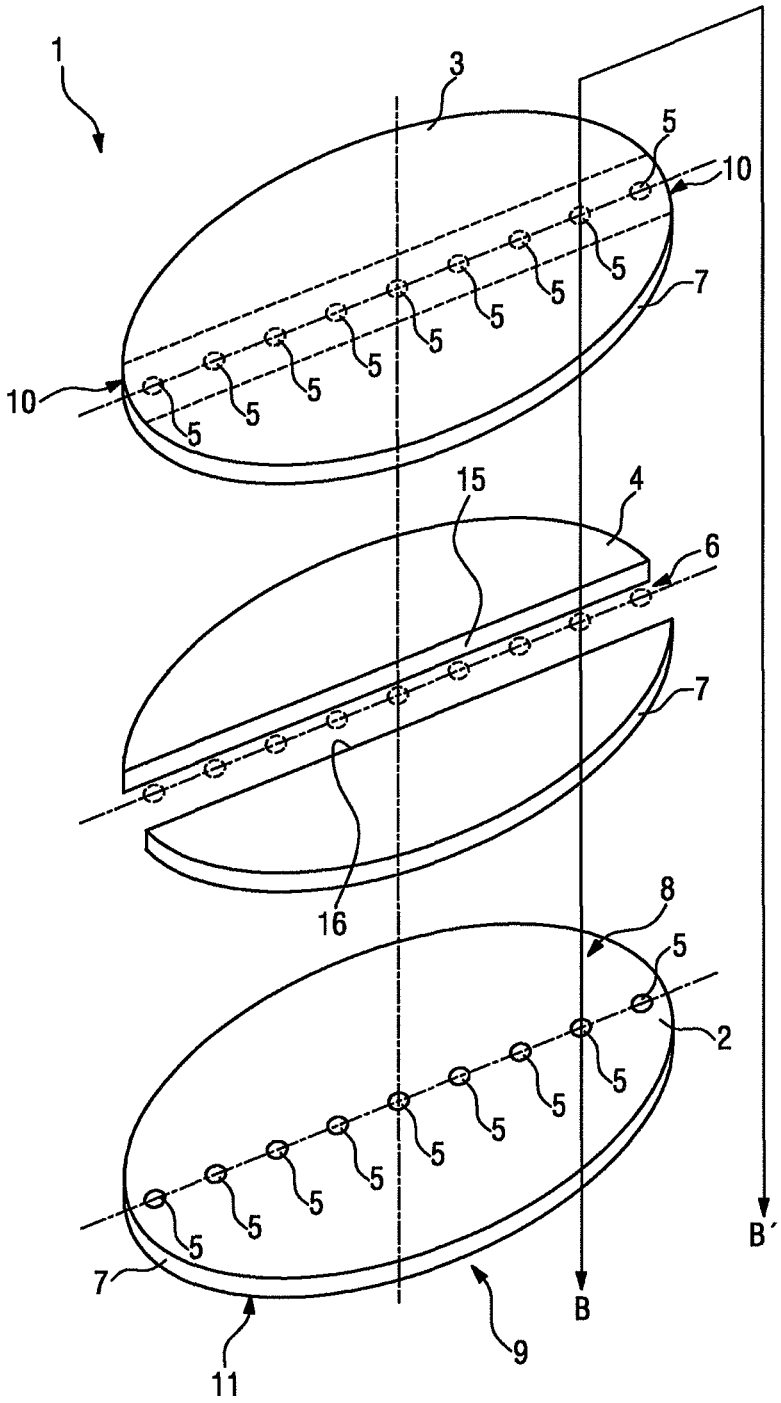
FIG. 4 schematically shows a second embodiment of a foil according to the invention.
Figure 5:
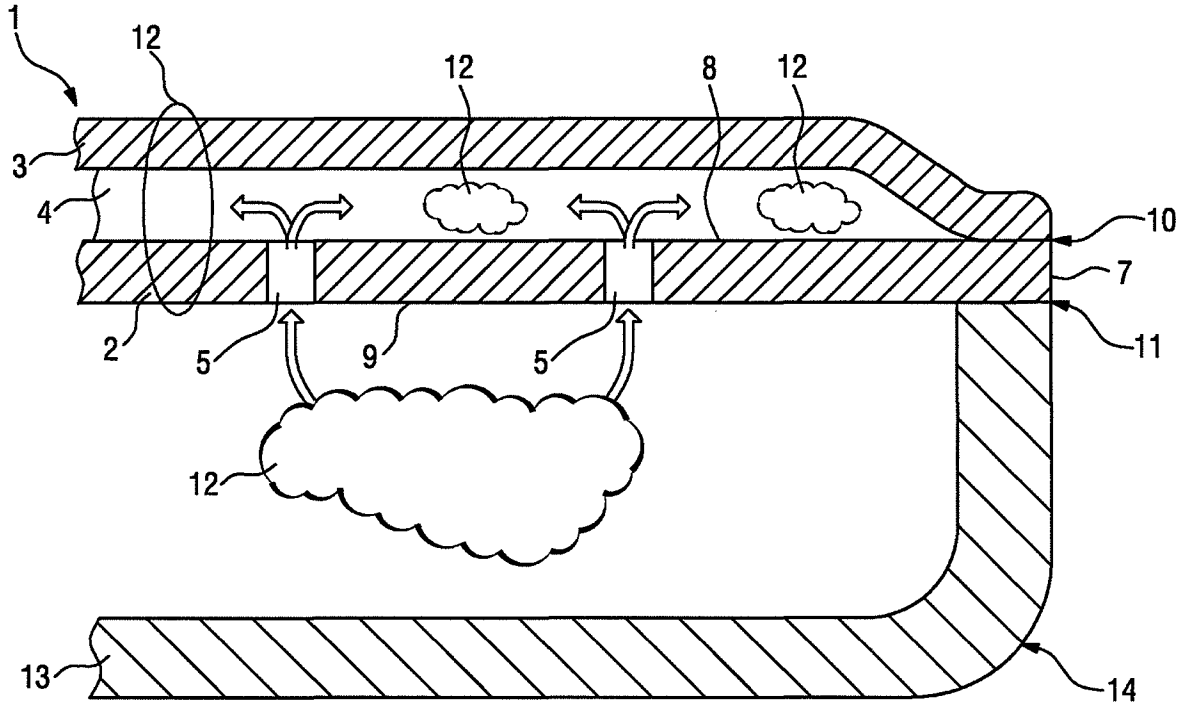
FIG. 5 schematically shows a package having the foil according to FIG. 4 as a lid for a tray with a closed first peel-able seal.
Figure 6:
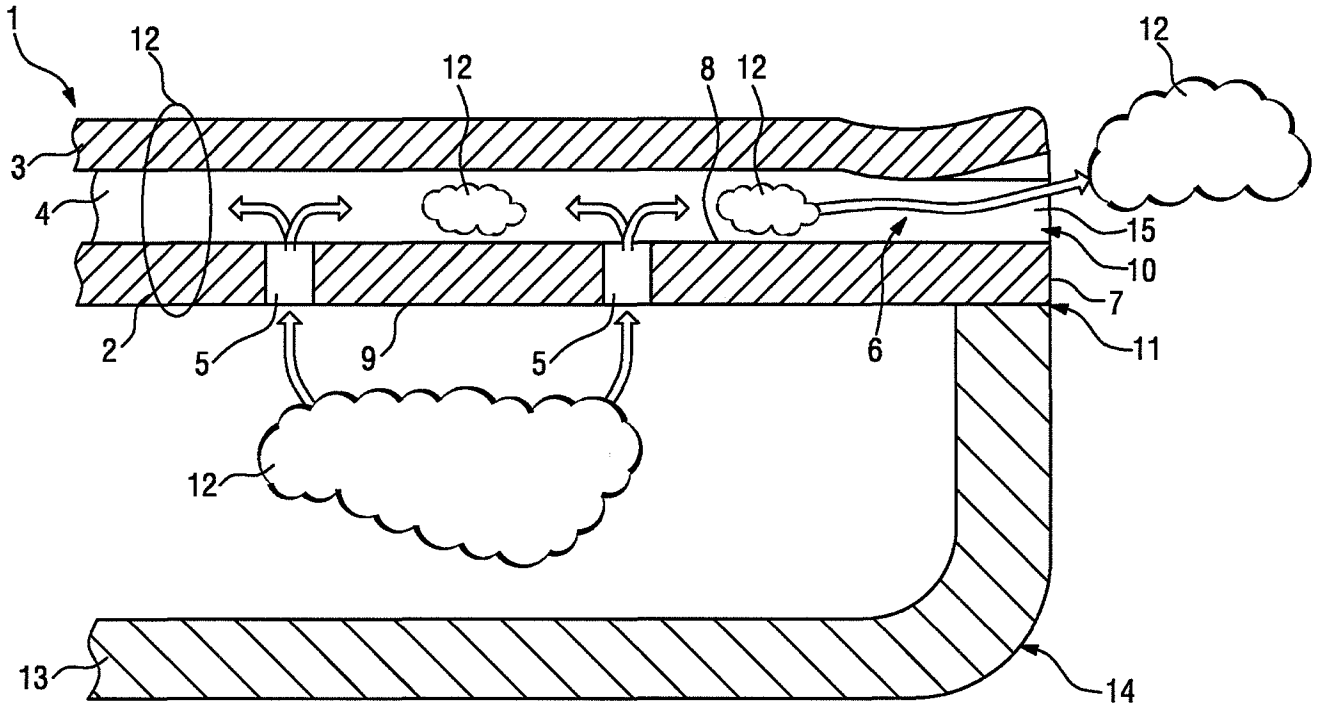
FIG. 6 schematically shows the package according to FIG. 4 with an opened first peel-able seal.

In contrast to the embodiment shown in FIG. 1 in the embodiment as shown in FIG. 4 the adhesive layer 4 leaves open the channel 6 that in the present case has the form of a straight line with parallel boundaries 15 and 16. The channel 6 opens into the punctures 5. In the present case the punctures 5 are aligned in a row in parallel to the boundaries 15 and 16. The channel 6 ends at the location of the first peel-able seal 10 at two different positions of the outer edge 7 of the foil 2. In analogy to the above-described embodiment also here the sealing of the first side 8 of the first plastic film 2 together with the bottom of the second plastic film 3 creates the adhesion peel seal. The closed first peel-able seal 10 and the opened first peel-able seal 10 are shown in FIGS. 5 and 6.

The method of manufacturing said foil 2 differs from the earlier mentioned method in that it does not necessitates the production of the punctures and the application of the adhesive in register with a printing mark, because these two activities are performed on the fly and independent from each other in production direction of the machine producing the foil 2.

Figure 7:
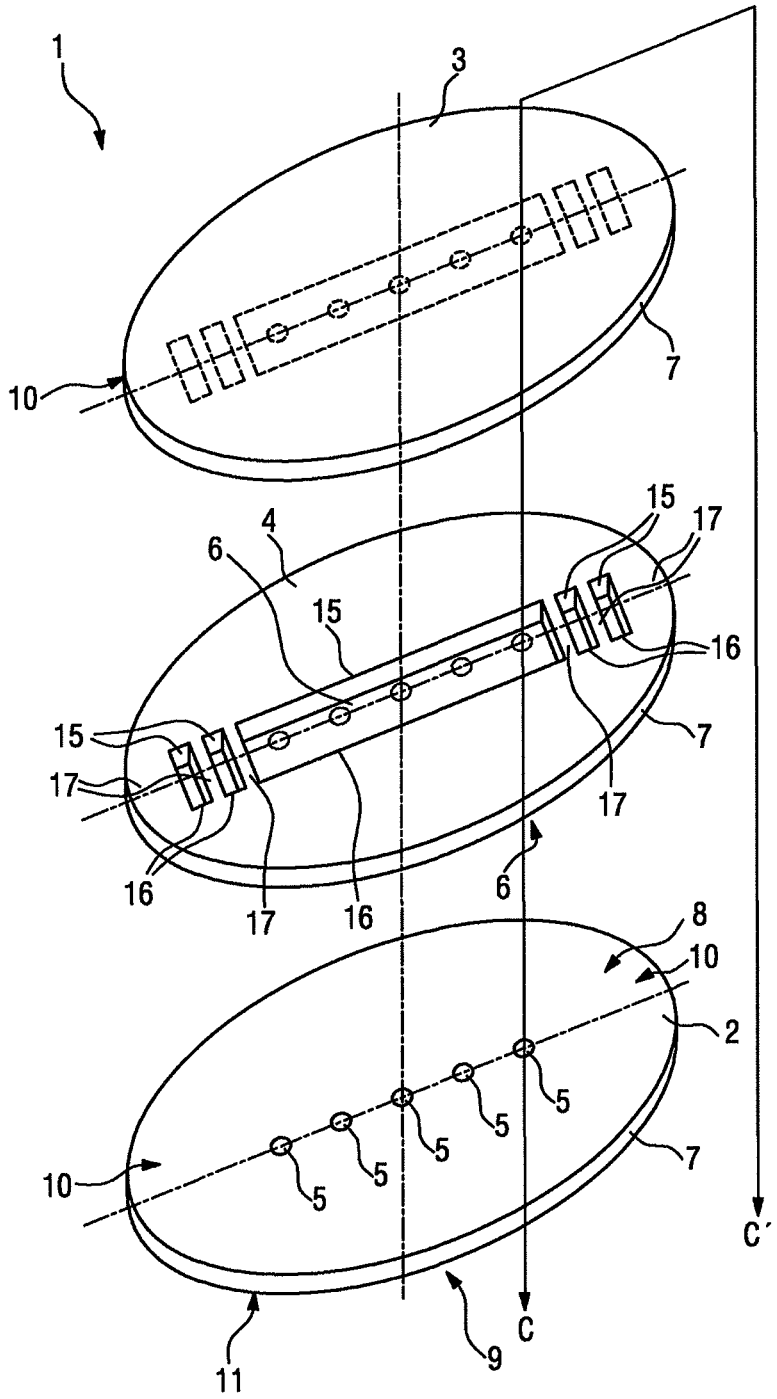
FIG. 7 schematically shows a third—preferred—embodiment of a foil according to the invention.
Figure 8:
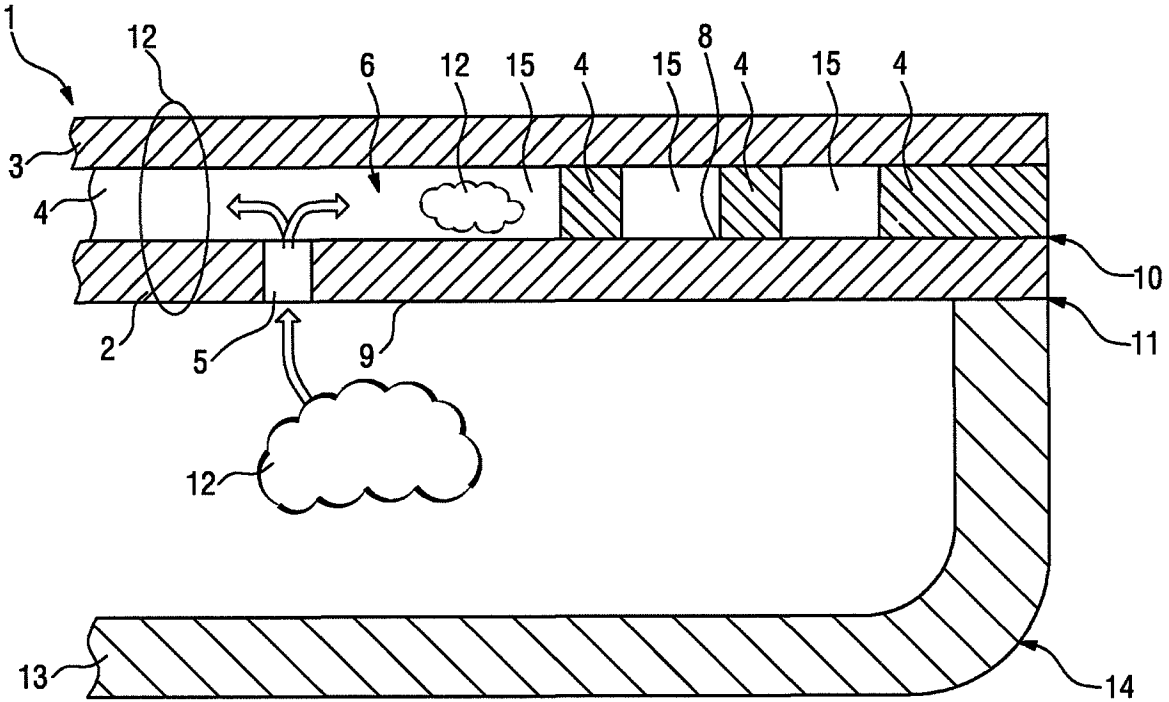
FIG. 8 schematically shows a package having the foil according to FIG. 7 as a lid for a tray with a closed first peel-able seal.
Figure 9:
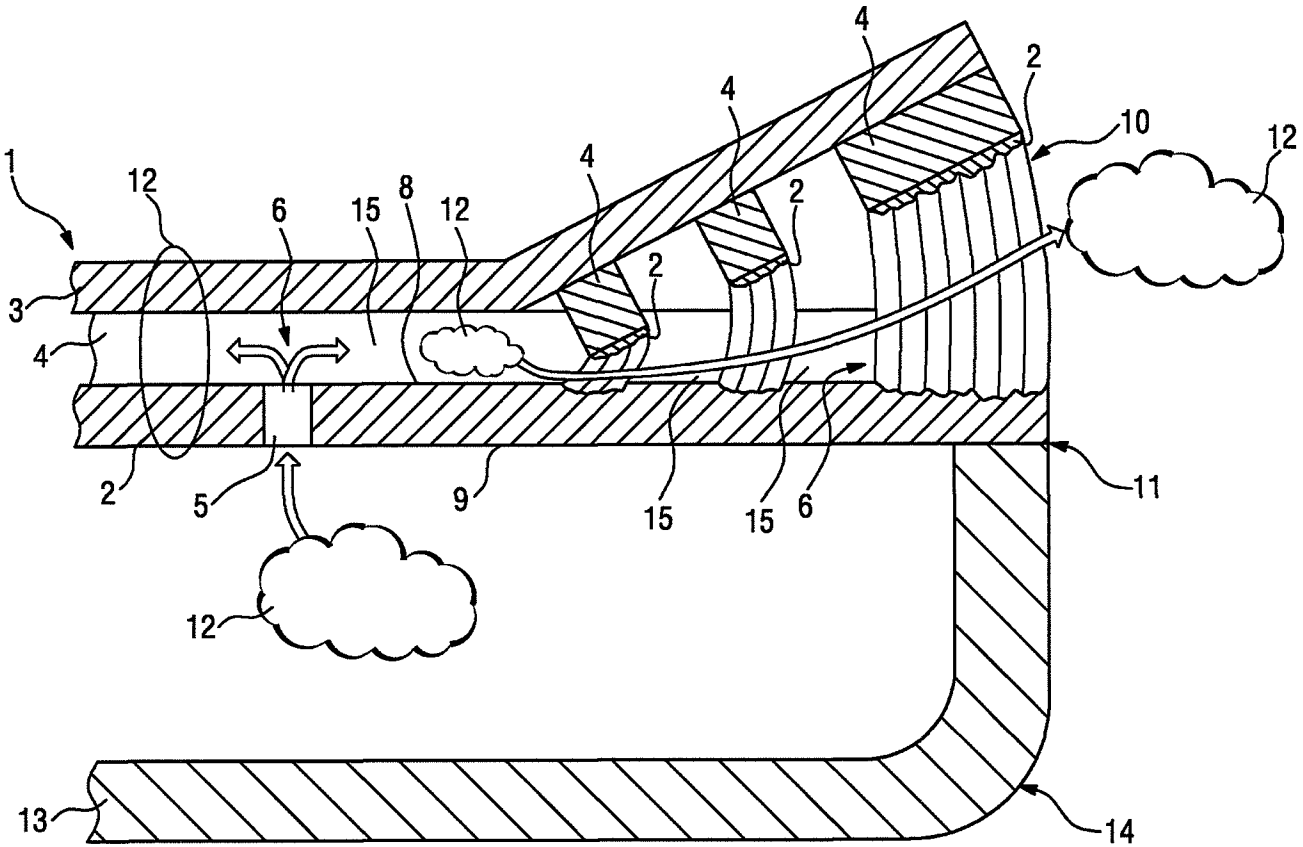
FIG. 9 shows the package according to FIG. 7 with an opened first peel-able seal.

FIGS. 7 to 9 relates to a third embodiment of the foil 2 according to the invention and its application in a package 14. According to this embodiment between the two films 2 and 3 the adhesive layer 2 tightly seals the punctures 5 from an outer edge 7 of the foil 2. Given the tight sealing by the aid of the adhesive layer 4, which implies that the two films 2 and 3 are spaced from each other and can not any more be sealed together, the first peel-able seal 10 is now created by another property of the first plastic film 2. In the present case the first plastic film 2 is designed to cerate in its structure a cohesive crack adjacent to the adhesive layer. This design allows to cerate a cohesion peel seal.

The structure of the foil 2 is visualized in FIG. 7, in which context it is emphasized that the sealing of the punctures 5 is realized in form of a number of strip-like extensions 17 of the adhesive layer 4 located within the channel 6 into which the punctures 5 are entering. The channel 6 extends between the two films 2 and 3 and ends at the outer edge 7 of the foil 2. For the avoidance of doubt it is emphasized that in the present case the channel 6 is defined as the combination of the area that is free of adhesive material and the opening (tunnel) created by the adhesive crack in the first plastic film 2.

The functioning of the cohesion peel seal is shown in the sequence of FIGS. 8 and 9, wherein in FIG. 8 the closed first peel-able seal 10 and in FIG. 9 the open first peel-able seal 10 is shown. The cohesive crack in the first plastic film 2 is shown by means of material of the first plastic film 2 still being adhered to the adhesive layer 4 as visualized in FIG. 9, such that said tunnel is crated within the first plastic film 2.

In particular—see FIG. 7 for example—the number of stripes is located adjacent to the outer edge of the foil in an area of the channel 6 that is free of punctures 5. The channel 6 ends at the outer edge 7 at two different positions and the channel 6 has the form of a straight line and the punctures 5 are distributed within said channel 6 and aligned in a row, in particular preferably in direction of the channel 6.

In the present case the method of manufacturing requires an alignment between the creation of the punctures 5 and the application of the adhesive layer 4 to such an extent that the punctures are not located in the area of the stripe-like extensions 17.

Figure 10:
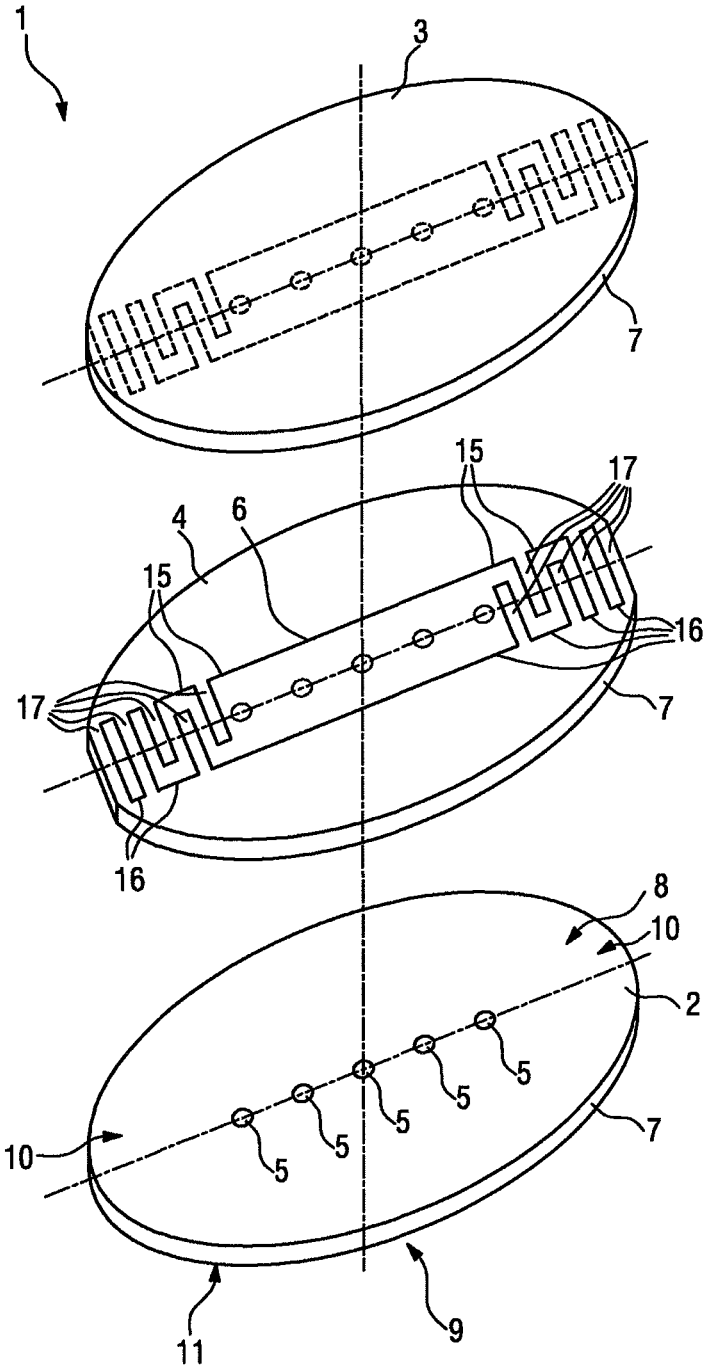
FIG. 10 schematically shows a forth embodiment of the foil according to the invention.

In FIG. 10 a further embodiment of the cohesion peel seal is depicted. In particular FIG. 10 shows a variation of the embodiment visualized in FIG. 7. In contrast to the solution according to FIG. 7 the adhesive layer 4 shown in FIG. 10 comprises the stripe-like extensions 17, wherein each extension 17 leaves open a gap between one of its ends and one of said boundaries 15 or 16 and the location of the gap with respect to the two boundaries 15 or 16 is alternated from one extension 17 to the other. Similar to the location of the extensions 17 as shown in FIG. 7 the extensions 17 according to this embodiment are located in an area adjacent to the outer edge 7 of the foil 2 and the area of the extensions 17 is free from openings of the punctures 5, which are grouped together between the inner most extensions 17. Again the end of the channel 6 is closed—more precisely hermetically seals the inside of the channel 6 from the outer edge 7 of the foil 2. This hermetic seal can be realized by one bar-like extension 17 of the adhesive layer 4, which is not shown in details, or as shown by a number of closely spaced stripe-like extensions 17 reaching from one boundary 15 to the other boundary 16. The function of the inner alternating extensions 17 basically remains the same as described in the context of the FIGS. 8 and 9, but its size and density can be used to further tune or optimize the opening (peel-off) behavior of the cohesion peel seal.

In a further embodiment also a combination of the adhesion peel seal and the cohesion peel may be considered. In such an embodiment the outer area of the first plastic film 2 is sealed together with the second plastic film 3—as illustrated in the FIG. 2—and adjacent and fee from punctures 5 may be an area with stripe-like extensions 17 as illustrated in the FIG. 7 or 10 or a combination of the extensions 17 shown in FIGS. 7 and 10.

According to a further embodiment the sealing of the punctures may also be realized by a solidly extension of the adhesive layer around the area of the punctures 5. This is not visualized in details but reference is made to the adhesive layer 4 as shown in FIG. 1, which according to this embodiment would completely surround the channel 6.

The embodiments of the foil 2 according to the invention as elaborated above may also be used in case of a flexible package like a flexible bag made of said foil 2. Such a flexible package (not shown in the figures) is manufactured by folding the foil 2, such that the second side 9 of the first plastic film 2 faces itself. Sealing the second side 9 together with itself cerates the second peel-able seal 11, while the function of the first peel-able seal 10 is entirely embedded within the sandwiched structure of the foil 2 as explained in the context of the embodiments above.

Without construing a limiting disclosure, it can be mentioned that during experiments good results were achieved by a foil having a PET made second plastic film with thickness of 12 μm, an adhesive layer with 1 to 4 g/m$^2$ of adhesive, and a first plastic film with a thickness of 40 to 90μ. Exemplary the number of round shaped punctures was selected between 1 to 10, each of the punctures had a diameter in the range of 350 to 3000 μm. The width of the channel may be chosen in the range between 5 to 30 mm.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the illustration enumerating several means, several of these means may be embodied by one and the same item. The mere fact that certain measures are recited in mutually different dependent claims does not indicate that a combination of these measures cannot be used to advantage.

The invention claimed is:

1. A peel-seal foil for providing a valve of a food package, the foil having an outer edge and comprising:

a first plastic film, and a second plastic film, and an adhesive layer interposed between the first plastic film and the second plastic film and disposed inwardly of said outer edge, and which laminates together the first and second plastic films, wherein the first plastic film has a first side and a second side and comprises punctures therebetween, said punctures being disposed between said outer edge and said adhesive layer, wherein the first plastic film realizes at its first side a first peel-able seal at said outer edge, wherein in its sealed state the first peel-able seal is sensitive to gas-pressure that is built up by gas that entered into the foil between the first and second plastic films through the punctures, such that the first peel-able seal is peeled-off if said gas-pressure exceeds a threshold and the gas can depart from the foil by passing along in-between the two films, and the first plastic film further realizes a second peel-able seal at its second side when sealed together with a structure, the second peel-able seal being non-sensitive to said gas-pressure, and wherein the adhesive layer leaves open the punctures such that gas can penetrate through the punctures in-between the two films and can pass towards the first peel-able seal, forming an outlet valve portion located at the outer edge of the foil.

2. The foil according to claim 1, wherein the adhesive layer leaves open a channel that extends between the punctures and the first peel-able seal, wherein the first peel-able seal is located at an outer edge region of the foil and is realized in its sealed state when the first side of the first plastic film is sealed together with the second plastic film.

3. The foil according to claim 1, wherein between the two films the adhesive layer tightly seals the punctures from an outer edge of the foil and the first peel-able seal in the form of the cohesion peel seal is realized by the aid of the first plastic film that has in its structure a cohesive crack adjacent to the adhesive layer.

4. The foil according to claim 3, wherein the sealing of the punctures is realized by a solid extension of the adhesive layer around an area of the punctures.

5. The foil according to claim 3, wherein the sealing of the punctures is realized in form of a number of stripe-like extensions of the adhesive layer located within a channel into which the punctures are entering, the channel extends between the two films and ends at the outer edge of the foil.

6. The foil according to claim 5, wherein the stripe-like extensions are located adjacent to the outer edge of the foil in an area of the channel that is free of openings of the punctures.

7. The foil according to claim 5, wherein the channel ends at the outer edge of the foil at two different positions and the channel has the form of a straight line and openings of the punctures are distributed within said channel.

8. The foil according to claim 1, wherein the adhesive layer leaves open a channel that has a form of a straight line with parallel channel boundaries and the openings of the punctures open into the channel, wherein said openings are aligned in a row in parallel to the boundaries and the channel ends at the location of the first peel-able seal at two different positions of the outer edge of the foil.

9. A package for food that comprises a tray and the peel seal foil according to claim 1, wherein the foil forms a lid of the package and an edge of the tray is sealed to an outer region of the second side of the first plastic film of the foil, such that the second peel-able seal is created.

10. A flexible package for food that is formed by the peel foil according to claim 1, having a portion at which the second peel-able seal is created.

* * * * *